United States Patent [19]

Scheurer et al.

[11] Patent Number: 4,759,734

[45] Date of Patent: Jul. 26, 1988

[54] WATER SKI BINDER

[75] Inventors: Robert S. Scheurer, P.O. Box 539, Wichita Falls, Tex. 76307; Kendal Hancock, Wichita Falls, Tex.

[73] Assignee: Robert S. Scheurer, Wichita Falls, Tex.

[21] Appl. No.: 945,570

[22] Filed: Dec. 23, 1986

[51] Int. Cl.[4] ..... A63C 9/00

[52] U.S. Cl. ..... 441/70; 441/68

[58] Field of Search ..... 491/68, 70; 280/611, 280/617, 623, 633, 634

[56] References Cited

U.S. PATENT DOCUMENTS

| | | | |
|---|---|---|---|
| 2,540,576 | 2/1951 | Goodhue et al. | 441/70 |
| 2,900,648 | 8/1959 | Hedlund et al. | 441/70 |
| 3,118,157 | 1/1964 | Houser | 441/70 |
| 3,703,013 | 11/1972 | Leach | 441/70 |
| 3,750,204 | 8/1973 | Walter | 441/70 |
| 3,798,691 | 3/1974 | Notermann et al. | 441/70 |
| 3,950,001 | 4/1976 | Weigl | 280/618 |
| 4,067,593 | 1/1978 | Earl | 280/617 |
| 4,296,511 | 10/1981 | Wright | 441/68 |
| 4,302,027 | 11/1981 | Himmetsberger et al. | 280/633 |
| 4,522,603 | 6/1985 | Doyle | 441/68 |

*Primary Examiner*—Sherman D. Basinger
*Assistant Examiner*—Edwin L. Swinehart
*Attorney, Agent, or Firm*—Dennis T. Griggs

[57] ABSTRACT

A slideable toe piece has rearward extensions which are cam locked in place in tunnels in the fixed heel piece.

6 Claims, 5 Drawing Sheets

FIG. 9
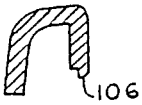
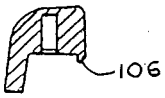
FIG. 10
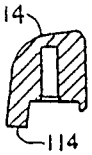
FIG. 11
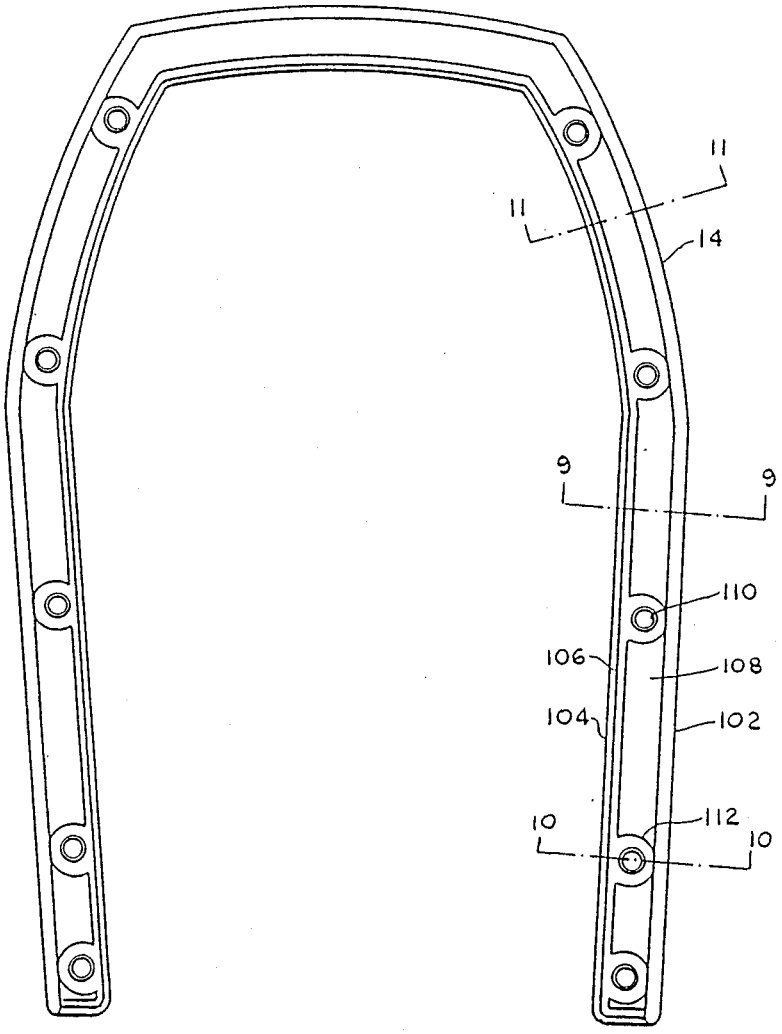
FIG. 7
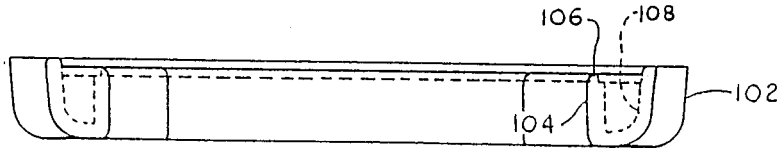
FIG. 8

FIG. 13
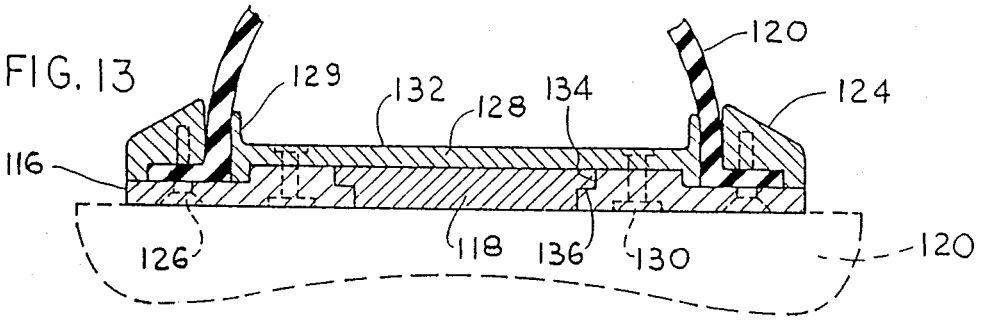
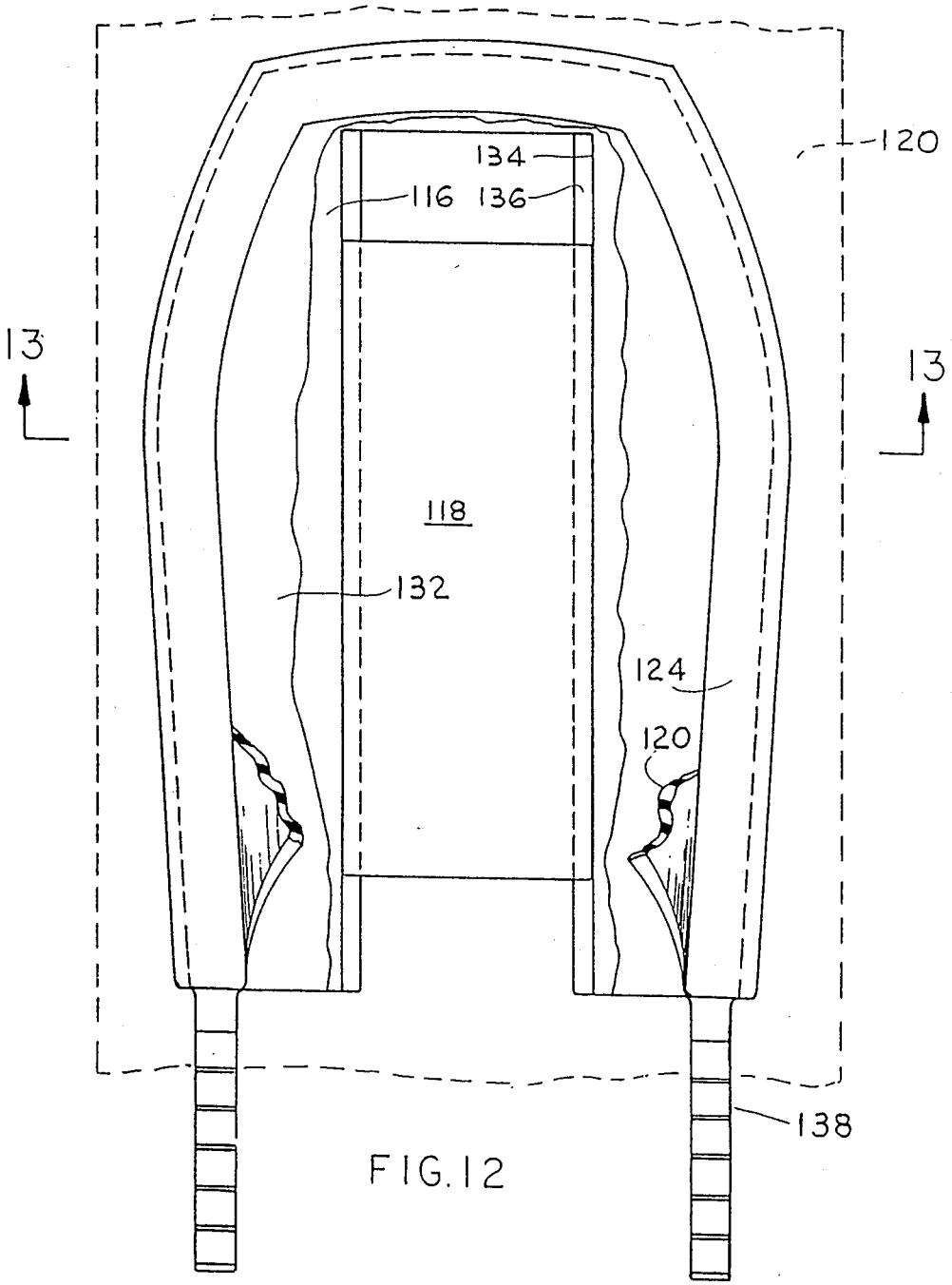
FIG. 12

WATER SKI BINDER

BACKGROUND OF THE DISCLOSURE

Many water ski foot binders have adjustable heel pieces. That creates two problems.

In water skiing, as in other forms of skiing, it is important to precisely position the center of gravity of the user. Slidably adjusting the heel piece to change the size of the binding axially moves the center of gravity, resulting in changed ski performance. In slalom ski bindings, it is important to place the trailing toe piece as close as possible to the leading heel piece. When the leading heel piece is slid forward to adjust the size of the front foot binder, the heel piece moves away from the rear toe piece, changing operational characteristics of the ski.

The present invention is designed to overcome problems inherent in the prior art and to provide a quickly and conveniently adjustable ski.

SUMMARY OF THE INVENTION

The present invention provides a rapidly and easily adjustable toe piece to quickly adjust and clamp the toe piece in position and to maintain the heel piece and center of gravity of the occupant in fixed position. The center of gravity or better the center of force applied on the ski by the occupant may be considered to be the center of the occupant's ankle bone. When attaching a ski to the foot, one easily slides one part of the binder open before inserting the foot and slides the binder part closed to capture the foot. When persons with different size feet use the same binders, centers of force are shifted longitudinally on the ski. When a single person uses a ski and when the bindings are adjusted for that one person, the center of gravity may be shifted slightly and adversely by changes in binding adjustment. Additionally, the rear toe in a slalom mount will be positioned too far behind the heel which slides along the ski.

The present invention provides easy fastening of the binding in its closed position by simply pushing down on two cams and easy release by simply pulling up on the two cams.

In a preferred embodiment, an adjustable toe binder apparatus comprises a flexible instep and toe cover having peripheral edges, grip means for gripping the peripheral edges and slide means for supporting the grip means and peripheral edges. Guiding means are mounted on the slide means for guiding the slide forward and rearward. First locking means mounted on the slide and second locking means connected to a fixed heel support cooperate with the first locking means to selectively permit and prevent movement of the slide.

Preferably, the first and second locking means comprise extension means and receiver means.

In a preferred embodiment the extension means is on the slide for extending into the receiver means, which is mounted on the heel piece.

The preferred extension means comprise upward facing detents, and the receiver means comprise pins extending transversely with respect to the binder and cam means mounted on the pins and lever means connected to the cam means for selectively rotating the cam means in one direction or the other around the pin means and urging the cam means into locking contact with the detents.

Preferably the extension means and detent means are mounted on the slide means and extend rearwardly therefrom. The second locking means is on the receiver means and the tunnel means which is mounted on the heel binder support. An opening extends longitudinally through the tunnel means and opens forwardly for receiving the extension means and detent means in sliding relationship.

Preferably the slide means and grip means are U-shaped. The guide means extend laterally from the slide means. Elongated openings receive fasteners fixed in an underlying water ski.

A preferred heel binder means comprises a generally forward opening flexible binder portion with peripheral edges, and a generally forward opening U-shaped plate overlying peripheral edges of the binder portion. Fastener means extend through the plate and the peripheral edges for securing the plate and the binder portion to the ski. The second locking, receiver and tunnel means are spaced laterally on forward portions of the U-shaped heel plate.

A preferred foot binder apparatus for water skis comprises a flexible end-opening cover having a generally U-shaped base with an outwardly extending peripheral flange portions. A generally U-shaped face place has an inner portion configured for overlying the outward extending flange portion of the flexible cover and trapping the flange portion between the water ski and the inner portion of the plate. Fastener means extend through the inner portion of the plate and the laterally extending flange portion and secure the cover and the plate to the water ski in fixed position.

A flexible second cover has an opposite opening and has a peripheral outwardly extending flange on a lower edge thereof. A generally U-shaped second plate has an inner portion for receiving the peripheral flange of the second cover and a generally U-shaped cap means for overlying the second cover flange and fastener means extending through the cover flange for holding the cover flange, cap means and plate assembled. Guide means connected to the second plate and extending longitudinally with respect to the ski permit longitudinal sliding of the second plate with respect to the ski. Guides connected to the ski and to the guide means prevent movement of the second plate away from the ski while permitting movement of the second plate along the ski. First and second adjustable locking means respectively connected to the second plate and to the first mentioned plate lock the second plate in a preselected position with respect to the first plate.

Preferably, the first and second locking means comprise extensions, receivers and cams for locking the extensions in the receivers. The preferred first locking means comprise rearward extensions at opposite rearward ends of the rearward opening U-shaped second plate, and the second locking means comprise forward opening tunnel shaped receivers in opposite ends of the forward opening U-shaped first plate.

Preferably, pins positioned in the first plate and extending transversely with respect to the ski are positioned above the tunnel shaped openings. Cams are mounted on the pins. Levers connected to the cams move the cams selectively forward and away from the extensions in the tunnel shaped receivers to lock the extensions in place or release the extensions.

Preferred extensions have upward facing detents for receiving the cams in selected positions.

A preferred method of adjusting a water ski binding comprises sliding a toe portion rearward and moving rearward extensions on the toe portions into complementary tunnels in the heel portions and moving cams on the heel portions into upward facing detents on the rearward extensions to lock the toe portions in place.

A preferred toe binder has a flexible instep and toe cover having peripheral edges, grip means for gripping the peripheral edges, slide means for supporting the grip means and peripheral edges, track means, connectable to a device on which the adjustable binding is to be mounted, for guiding the slide means forward and rearward, first locking means, connected to the slide means, for cooperating with second locking means connected to a fixed heel support to selectively permit and prevent movement of the slide means.

In another embodiment, the grip means comprises a U-shaped bar adapted to overlie a peripheral edge of the flexible instep and toe cover and means for connecting the U-shaped bar to the peripheral edges.

In another embodiment, the slide means comprises a toe plate being generally U-shaped and having a stepped central portion slidably receiving a shoulder portion of the track means, wherein the stepped and shoulder portions provide guide means for guiding the toe plate forward and rearward.

Preferably, the slide means further comprises an upper plate, connected to an upper surface of the toe plate, and being adapted to carry a portion of a user's foot, wherein a T-shaped groove is defined by a lower surface of the upper plate and inner stepped side walls of the toe plate.

In a preferred embodiment, the track means comprises a stationary T-shaped plate slidably supporting the toe plate and corresponding in dimensions to the T-shaped groove.

Preferably, the toe plate, upper plate and U-shaped bar are integrally formed in a one-piece construction.

The above and further and other objects and features of the invention are apparent in the disclosure which includes the above and ongoing specification with the claims and the drawings.

BRIEF DESCRIPTION OF THE DRAWINGS

FIG. 7 is a bottom view of the toe cap piece for clamping the flexible toe and instep cover to the toe plate.

FIG. 8 is an end elevation of the toe plate and clamp shown in FIGS. 5, 6 and 7.

FIGS. 9, 10 and 11 are details taken along lines 9—9, 10—10 and 11—11 of the upper clamping member shown in FIG. 7.

FIG. 12 is a top plan view of another embodiment of the toe plate of the present invention.

FIG. 13 is a cross sectional view of the embodiment of FIG. 12.

DETAILED DESCRIPTION OF THE DRAWINGS

Figure 1:
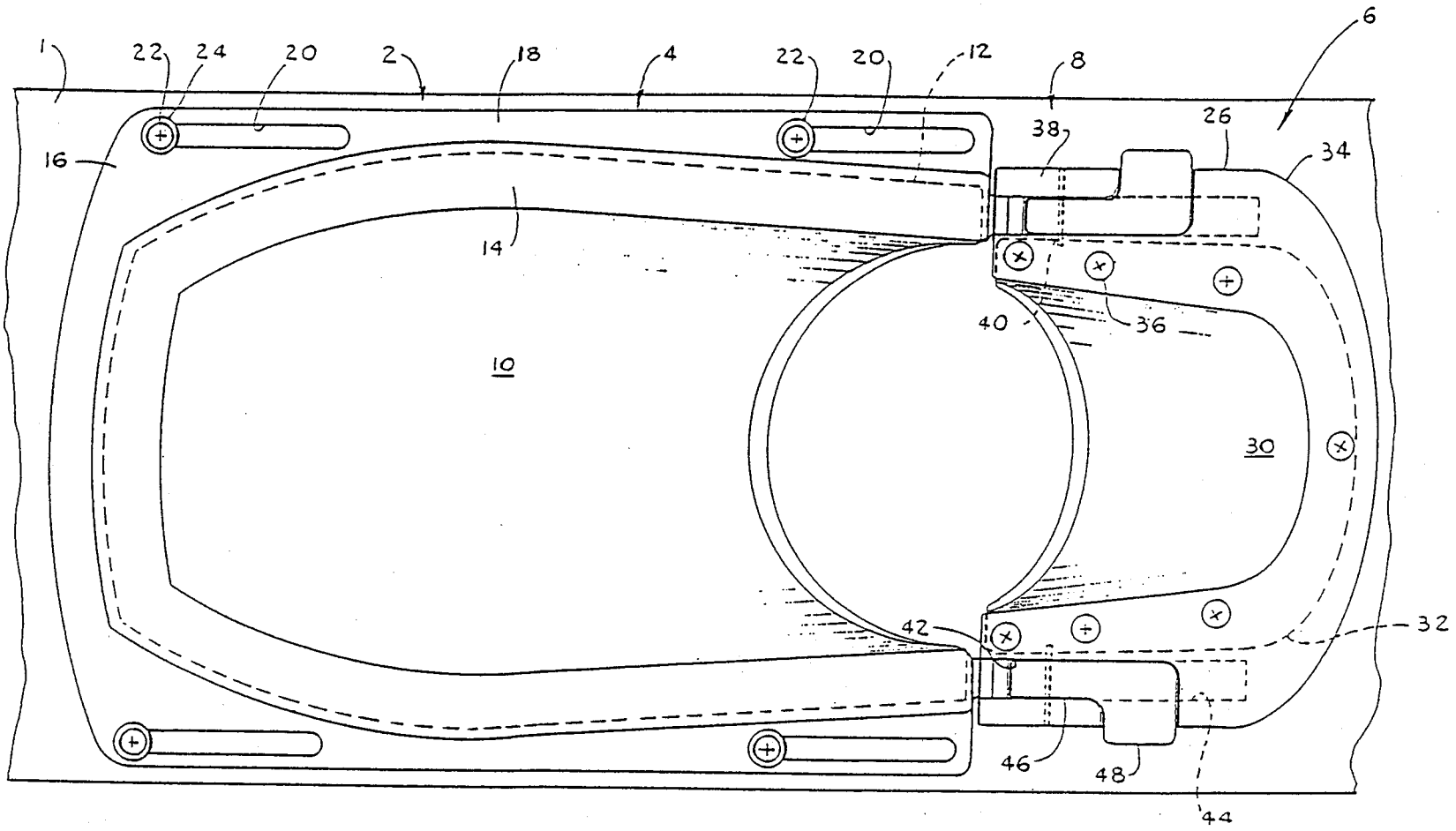
FIG. 1 is a plan view of the foot binder with the adjustable toe piece of the present invention.

In the preferred form of the invention as shown in the drawings, a ski is generally indicated by the numeral 1. A binder generally indicated by the numeral 2 has a toe portion 4 and a heel portion 6. The two portions are joined by locking means generally indicated by the numeral 8. The toe portion 4 has a toe retainer generally indicated by the numeral 10 which covers the toe and instep of the foot of a user. A peripheral outward extending flange 12 of the toe cover 10 is held tightly on the toe piece 4 by fasteners which extend into a generally U-shaped rearward opening cap clamp member 14 and similar U-shaped toe plate 16. Lateral portions 18 of toe plate 16 which extend outward from cap 14 have longitudinally extended openings 20 which slide along non-threaded outer portions of screws 22 which are anchored in the ski 1. Enlarged heads or washers 24 ride atop the lateral areas 18 of the toe plate 16, holding the toe plate firmly against the ski while permitting it to slide for adjustment.

A forward opening, flexible, heel retainer 30 has an outward extending flange portion 32, which extends beneath the heel plate 34. Fasteners 36 pass through the peripheral flange 32 and clamp the flange 32 to the ski 1. The heel plates have lateral extensions 38 which mount the locking means 8. Pins 40 extend through the openings 42 which extend upward from longitudinally extending tunnels 44 in the heel pieces 6. Eccentric cams 46 with operating levers 48 are mounted on the pins 40 as over-the-center clamps to clamp rearward extensions to the toe piece within the tunnels 44 to fix the toe piece in place on the ski.

Figure 2:
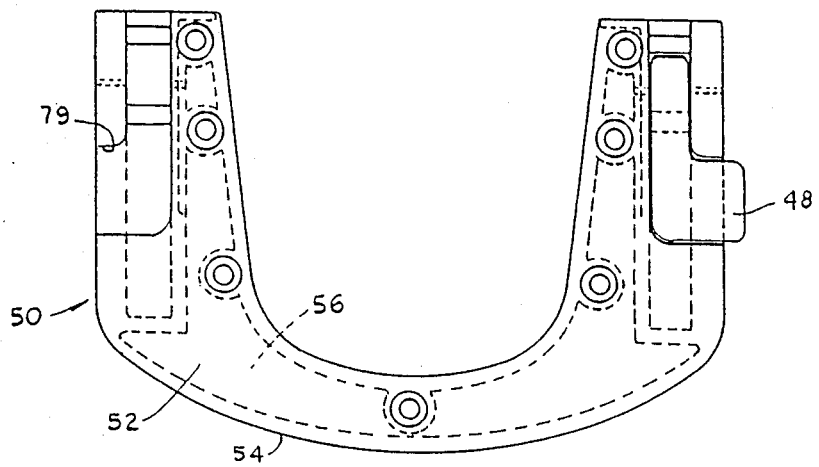
FIG. 2 is a plan view of the heel plate.

A top plan view of a preferred modified heel plate 50 is shown in FIG. 2. Heel plate 50 is a hollow molded piece with a generally rounded upper surface 52 and an outer wall 54 surrounding an internal hollow space 56 as can be seen with reference to the bottom view shown in FIG. 4. Inner wall 58 has a lip 60 which slightly compresses flange 32 to trap the flange between the ski 1 and the plate 50. Countersunk holes 62 are provided to receive screws which extend through the flange 32 into the ski. As shown, the screw holes 62 are formed in inward cylindrical extensions 64 of the inner wall 58. Opening 66 extends upward from a tunnel 70, and a hole 68 communicating with the opening 66 receives a pin 40 as shown in FIG. 1 for mounting the cam 46.

Figure 3:
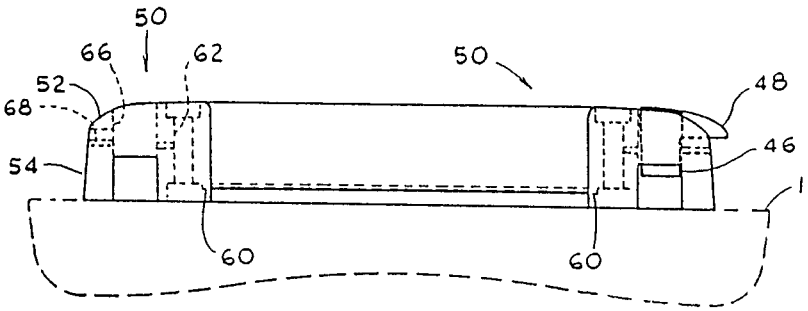
FIG. 3 is an end elevation of the heel plate shown in FIG. 2, showing the mountings of the heel rubber and cam.
Figure 4:
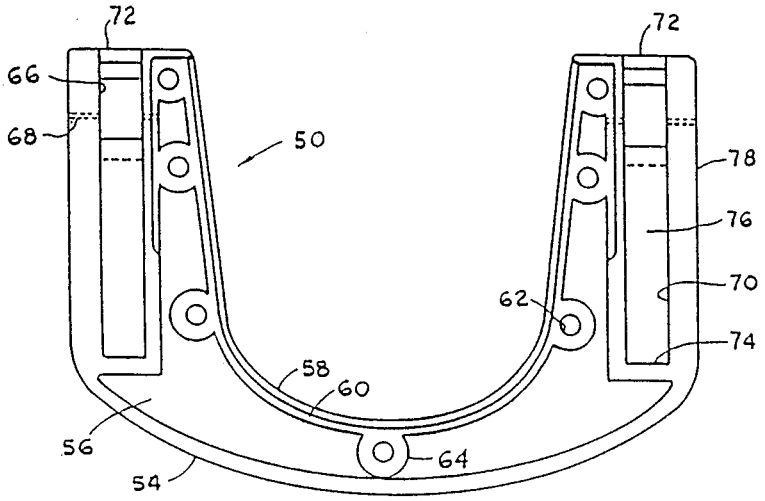
FIG. 4 is a bottom view of the preferred heel plate shown in FIGS. 2 and 3.

Tunnels 70 as showns in FIGS. 2, 3 and 4 differ slightly from the tunnels 44 shown in FIG. 1. While the forward ends 72 of the tunnels are open, the rearward ends are closed. The relatively thick section of the top 76 of the tunnel and the outerwall 78 of the tunnel 70 supports the locking means without requiring the outer screw.

As shown in FIGS. 2 and 3 in one preferred embodiment, the cam lever 48 is positioned within recess 79 so that the upper surface of the cam lever is flush with the top of the heel plate and so that the outer end of the cam lever 48 may extend beyond the heel plate for ease in release.

Figure 6:
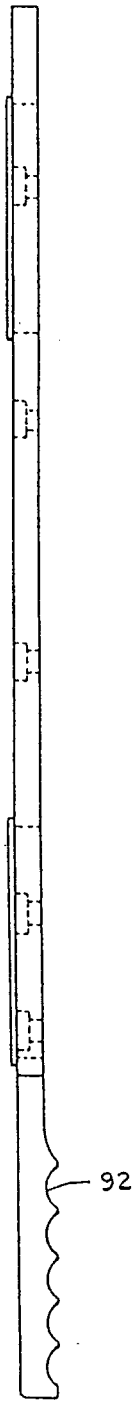
FIG. 6 is a side elevation of the toe plate shown in FIG. 5.
Figure 5:
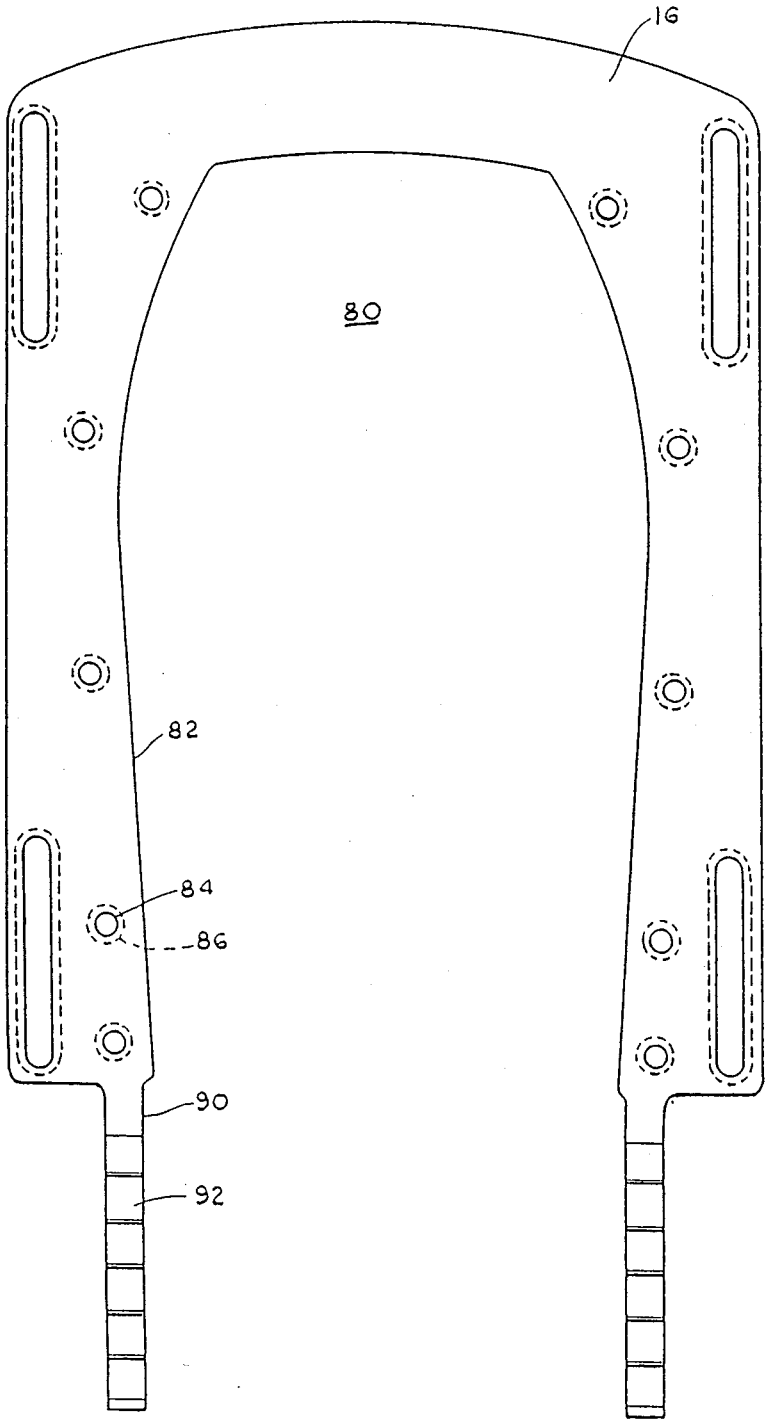
FIG. 5 is a top plan view of the preferred toe plate of the present invention.

As shown in FIGS. 5 and 6, the preferred toe plate has an open center 80 so that the foot of a user may rest directly upon the ski 1. Alternatively, the toe plate may extend across the surface of the ski beneath the foot of the user.

The inner edge 82 of the toe plate is curved inwardly and rearwardly to create the desired shape of the flexible boot and to bring the arch portion inward for foot support. Holes 84 are countersunk 86 from the bottom of the plate to receive the heads of fasteners which extend upward through the flange of the flexible toe cover and into the cap piece where they are secured. The rearward extensions 90 have detents 92 in their upper surfaces to receive the eccentric cams which are mounted in the heel piece.

As shown in FIG. 7, the preferred cap 14 has an outer wall 102 which extends downward to the upper surface of the plate 16. An inner wall 104 has a lip 106 which compresses the flange 12 of the toe cover to hold the flange tightly against the plate 16. An area 108 between the walls 102 and 104 is recessed to provide weight reduction. Holes 110 in cylindrical portions 112 receive fasteners which extend through the peripheral flanges of the toe cover. The holes may be threaded to receive the fasteners of self threading fasteners may cut threads in the material around the holes. The holes may be countersunk to aid in the centering of the screws.

As shown in FIGS. 9, 10 and 11, the distance between the bottom of the cylindrical portions 12 and the lip 106 and the base 114 of the cap 14 may vary to take into account the thicker cross section of the top cover near the stress receiving instep portion.

The embodiment of FIGS. 12 and 13 represents an alternative arrangement for the toe plate.

Referring to FIGS. 12 and 13, a toe plate 116 is mounted for fore and aft sliding movement along stationary T-track or plate which is fixedly connected to an upper surface 118 of a ski 120 by any conventional means including screws, bolts, or other fasteners, and adhesive bonding. T-track 118 could also be molded into the upper surface of the ski during the molding process of the ski, and might in such case be required to extend into the upper surface.

The T-track 118 will guide the toe plate 116 while adjustments are made.

The toe cover 120 is connected to an upper surface of the toe plate 116 by fitting a peripheral edge portion 122 of the toe cover 120 onto the upper surface and sandwiching the edge portion 122 between the toe plate 116 and a U-shaped bar 124. The toe plate 116, the edge portion 122 and the U-shaped bar 124 may all be interconnected by means of screws 126 or other suitable fasteners or fastener means which extend through bores provided in the various components.

An upper plate 128 is fixedly connected to the toe plate 116 by screws or bolts 130 or by other suitable fasteners or fastening means. An upper surface 132 of the upper plate 128 carries a portion of a user's foot, while the opposite surface slides over an upper surface of the T-track.

The upper plate 128 is provided with an upstanding edge 129 that helps guide the toe cover 120 upwardly to keep the toe cover from rubbing on the sides of a user's foot. The upstanding edge 129 also makes it easier to remove and insert the user's foot.

It should also be understood that the toe cover 120 can be open in the front of expose or potentially expose the toes of a user's foot. In that case, it may be necessary to make the U-shaped bar 124 non-U-shaped by removing the forward portion thereof. It may also be necessary to remove the forwardmost portion of the upstanding edge 129. If the open toed embodiment is used, the U-shaped bar 124 may instead be broken into two parallel opposite side portions which are screw connected in the same manner as illustrated in FIG. 13.

In one embodiment of the invention, the toe plate 116, U-shaped bar 124 and upper plate 128 are integrally formed in a molding process as, for instance, when plastics materials are used.

Preferably, the T-track 118 has a shoulder portion 134 which mates with stepped portion 136 of the toe plate 116. The shoulder and step arrangement limits the movement of the toe plate 116 to fore and aft movement.

The desired location of the toe plate 116 is locked into place by the rearward extensions 138 which are used in a similar fashion to rearward extensions 90.

Due to the fact that the T-track 118 provides substantial support and stability on both sides of the toe plate, one of the two extensions 138 may be eliminated, and this would obviate the need for corresponding and cooperating structure in the heel binding.

In either case, whether one or two extensions are used, the extensions may be arranged such that the cam can be mounted on the side instead of on top. In other words, with slight variations, the embodiment of FIG. 1 could be arranged such that the extensions are turned 90 degrees and also the lever 48 could be mounted for rotation on the side of the heel binding.

In another variation, the embodiments of both FIGS. 1 and 12 could be modified such that the front of the toe binding is "open-toed", meaning that instead of being substantially U-shaped, the forwardmost portion of the toe binding which extends across and in front of the user's toes would be removed, leaving an open area through which the toes could extend. In the embodiment of FIG. 12, the toe cover 120 would have an open forward portion and the U-shaped bar could consist of two parallel opposite side portions which are not interconnected at the front as currently shown in FIG. 12.

The length of the T-track 118 would be related to the amount of adjustment desired in the toe binding. Stops may be provided at either end of the toe plate to prevent the toe plate from separating from the T-track, if desirable.

While the invention has been described with reference to specific embodiments, modifications and variations may be constructed without departing from the scope of the invention which is defined in the following claims.

What is claimed is:

1. Adjustable toe binder apparatus comprising, in combination:

a flexible instep and toe cover having a peripheral edge;

grip means for gripping the peripheral edge;

track means, connectable to a device on which the adjustable binding is to be mounted, having a shoulder portion for guiding slide means forward and rearward;

said slide means supporting the grip means and peripheral edge, said slide means including a toe plate being generally U-shaped and having a stepped central portion slideably receiving the shoulder portion of the track means, wherein the stepped central portion and shoulder portion provide guide means for guiding the toe plate forward and rearward, and an upper plate, connected to an upper surface of the toe plate, being adapted to carry a portion of a user's foot, wherein a T-shaped groove is defined by a lower surface of the upper plate and inner stepped sidewalls of the toe plate; and, first locking means, connected to the slide means, for cooperating with second locking means connected to a fixed heel support to selectively permit and prevent movement of the slide means.

2. The apparatus of claim 1 wherein the grip means comprises a U-shaped bar adapted to overlie a peripheral edge of the flexible instep and toe cover and means for connecting the U-shaped bar to the peripheral edges.

3. The apparatus of claim 1 wherein the track means comprises a stationary T-shaped plate slidably supporting the toe plate and corresponding in dimensions to the T-shaped groove.

4. The apparatus of claim 2 wherein the toe plate and upper plate are integrally formed in a one-piece construction.

5. The apparatus of claim 1 wherein the grip means comprises a side bar adapted to overlie the peripheral edge of the flexible instep and toe cover and means for connecting the side bar to the peripheral edge, wherein the flexible instep and toe cover has an opening at a forward portion thereof, and wherein the first locking means comprises an extension cooperating with the second locking means, wherein the second locking means comprises a receiver.

6. An improved ski assembly comprising, in combination:

a ski;

a fixed heel support mounted onto the ski;

a toe binder movably mounted on said ski and adjustably coupled to said fixed heel support, said adjustable toe binder including a flexible instep and toe cover having a peripheral edge, grip means for gripping the peripheral edge, track means mounted onto said ski for guiding slide means forward and rearward;

said slide means supporting the grip means and peripheral edge, said slide means including a toe plate disposed for sliding movement along said ski, said toe plate having a central channel and stepped sidewall portions on opposite side of the channel;

an upper plate secured to the toe plate and overlying said slot;

said track having a T configuration in cross section, said track having flange portions received within said slot and engaging, said stepped sidewall portions for guiding said toe plate as it is moved forward and aft relative to said fixed heel support, and said track having a load bearing surface disposed in slidable engagement against said upper plate.

* * * * *

UNITED STATES PATENT AND TRADEMARK OFFICE

CERTIFICATE OF CORRECTION

PATENT NO. : 4,759,734

DATED : July 26, 1988

INVENTOR(S) : Robert S. Scheurer, et al.

It is certified that error appears in the above-identified patent and that said Letters Patent is hereby corrected as shown below:

Column 5, line 22, "12" should be -- 112 --.

Column 5, line 60, "of" should be -- to --.

Signed and Sealed this

Seventh Day of May, 1991

*Attest:*

HARRY F. MANBECK, JR.

*Attesting Officer*

*Commissioner of Patents and Trademarks*